US009811008B2

(12) United States Patent
Noguchi et al.

(10) Patent No.: US 9,811,008 B2
(45) Date of Patent: Nov. 7, 2017

(54) IMAGE FORMING METHOD, PROCESS CARTRIDGE, AND ELECTROPHOTOGRAPHIC APPARATUS

(71) Applicant: CANON KABUSHIKI KAISHA, Tokyo (JP)

(72) Inventors: Kazunori Noguchi, Suntou-gun (JP); Yuka Ishiduka, Suntou-gun (JP); Yuki Yamamoto, Tokyo (JP); Atsushi Okuda, Yokohama (JP); Akihiro Maruyama, Mishima (JP); Atsushi Fujii, Yokohama (JP); Nobuhiro Nakamura, Numazu (JP); Kazuko Sakuma, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/205,707

(22) Filed: Jul. 8, 2016

(65) Prior Publication Data

US 2017/0010556 A1 Jan. 12, 2017

(30) Foreign Application Priority Data

Jul. 10, 2015 (JP) ..... 2015-138902

(51) Int. Cl.

| | |
|---|---|
| ***G03G 5/00*** | (2006.01) |
| ***G03G 5/04*** | (2006.01) |
| ***G03G 15/04*** | (2006.01) |
| ***G03G 21/00*** | (2006.01) |
| ***G03G 21/08*** | (2006.01) |
| ***G03G 5/06*** | (2006.01) |
| ***G03G 5/147*** | (2006.01) |

(52) U.S. Cl.

CPC ..... *G03G 5/04* (2013.01); *G03G 5/0614* (2013.01); *G03G 5/0696* (2013.01); *G03G 5/14752* (2013.01); *G03G 5/14756* (2013.01); *G03G 5/14773* (2013.01); *G03G 15/04* (2013.01); *G03G 21/0047* (2013.01); *G03G 21/08* (2013.01); *G03G 2215/0145* (2013.01)

(58) Field of Classification Search

CPC . G03G 5/14773; G03G 21/0047; G03G 15/04
USPC ..... 430/66
See application file for complete search history.

(56) References Cited

U.S. PATENT DOCUMENTS

2011/0158683 A1* 6/2011 Okuda ..... G03G 5/0564 399/111

FOREIGN PATENT DOCUMENTS

| | | |
|---|---|---|
| JP | 5-158249 A | 6/1993 |
| JP | 2007-79555 A | 3/2007 |

* cited by examiner

*Primary Examiner* — Mark A Chapman
(74) *Attorney, Agent, or Firm* — Canon U.S.A., Inc. IP Division

(57) ABSTRACT

An image forming method in which a surface layer of an electrophotographic photosensitive member contains a compound having a specific structure in an amount of 0.1% to 10% by mass based on the total mass of the surface layer, and in a charged region of the surface of the electrophotographic photosensitive member charged in a charging step, a non-image forming region in which an electrostatic latent image is not formed is not irradiated with destaticizing light or is irradiated with reduced destaticizing light.

12 Claims, 2 Drawing Sheets

IMAGE FORMING METHOD, PROCESS CARTRIDGE, AND ELECTROPHOTOGRAPHIC APPARATUS

BACKGROUND

Field of the Disclosure

The present disclosure relates to an image forming method, a process cartridge, and an electrophotographic apparatus.

Description of the Related Art

An electrophotographic apparatus forms images by transferring toner images formed on an electrophotographic photosensitive member to a transfer material. After the images are formed, the transfer residual toner remaining on the surface of the electrophotographic photosensitive member is generally removed by using a cleaning blade.

In recent years, miniaturization and speeding-up of an electrophotographic apparatus have been required, and thus the circumferential speed of an electrophotographic photosensitive member has been increased. An increase in circumferential speed of the electrophotographic photosensitive member has increased the load of a cleaning blade on the electrophotographic photosensitive member, and thus further improvement in slidability of the surface of the electrophotographic photosensitive member has been required.

Japanese Patent Laid-Open No. 5-158249 discloses a technique for an electrophotographic photosensitive member with a surface containing a resin having a siloxane structure for improving slidability of the surface of the electrophotographic photosensitive member.

SUMMARY

The present disclosure relates to an image forming method including (1) charging the surface of an electrophotographic photosensitive member, (2) forming an electrostatic latent image by exposing the charged surface of the electrophotographic photosensitive member, (3) forming a toner image on the surface of the electrophotographic photosensitive member by developing the electrostatic latent image with a toner, (4) transferring the toner image to a transfer material through or without through an intermediate transfer body, (5) removing the transfer residual toner from the surface of the electrophotographic photosensitive member after the toner image is transferred, and (6) irradiating the surface of the electrophotographic photosensitive member, from which the transfer residual toner has been removed, with destaticizing light for eliminating residual charge on the surface of the electrophotographic photosensitive member. A surface layer of the electrophotographic photosensitive member contains a compound having a structure represented by formula (1) below in an amount of 0.1% to 10% by mass based on the total mass of the surface layer. When in a charged region of the surface of the electrophotographic photosensitive member charged in the step (1), a charged region in which the electrostatic latent image is formed in the step (2) is referred to as an "image forming region" and a charged region in which the electrostatic latent image is not formed is referred to as a "non-image forming region", the non-image forming region is not irradiated with the destaticizing light or is irradiated with the reduced destaticizing light in the step (6).

(1)

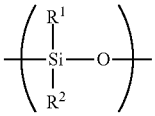

In the formula (1), $R^1$ and $R^2$ each independently represent a methyl group, an ethyl group, or a phenyl group.

Further features of the present disclosure will become apparent from the following description of exemplary embodiments with reference to the attached drawings.

DESCRIPTION OF THE EMBODIMENTS

Figure 1:
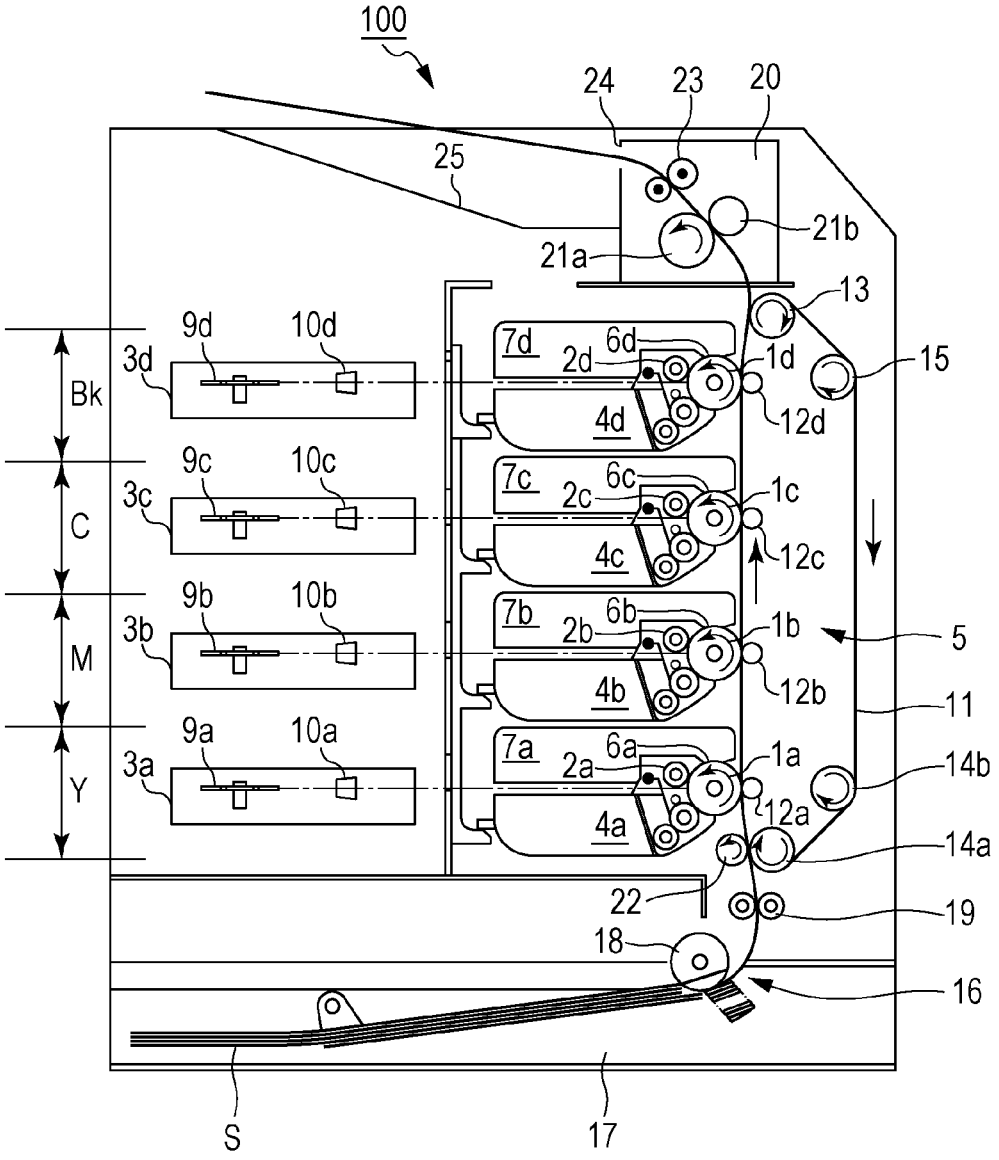
FIG. 1 is a drawing showing a schematic configuration of an electrophotographic apparatus including a process cartridge provided with an electrophotographic photosensitive member according to the present disclosure.

In recent years, the need for higher quality of electrophotographic images has gone on increasing. Further, miniaturization and an increase in number of printed sheets have been required, and the circumferential speed of an electrophotographic photosensitive member has been significantly increased.

As a result of research performed by the inventors, it was found that in the technique disclosed in Japanese Patent Laid-Open No. 5-158249, an increase in the circumferential speed of the electrophotographic photosensitive member may decrease the slidability of the surface of the electrophotographic photosensitive member and thus increase the torque of the electrophotographic photosensitive member. When the torque of the electrophotographic photosensitive member is increased, the electric power amount of a motor used for rotating the electrophotographic photosensitive member is undesirably required to be increased, and thus further improvement is required from the viewpoint of energy saving.

Accordingly, an object of the present disclosure is to provide an image forming method capable of suppressing an increase in torque of an electrophotographic photosensitive member even when the electrophotographic photosensitive member has a higher circumferential speed, a process cartridge, and an electrophotographic apparatus.

The present disclosure relates to an image forming method including (1) a step (hereinafter, referred to as a "charging step") of charging the surface of an electrophotographic photosensitive member, (2) a step (hereinafter, referred to as an "electrostatic latent image forming step") of forming an electrostatic latent image by exposing the charged surface of the electrophotographic photosensitive member, (3) a step (hereinafter, referred to as a "development step") of forming a toner image on the surface of the electrophotographic photosensitive member by developing the electrostatic latent image with a toner, (4) a step (hereinafter, referred to as a "transfer step") of transferring the toner image to a transfer material through or without through an intermediate transfer body, (5) a step (hereinafter, referred to as a "cleaning step") of removing the transfer residual toner from the surface of the electrophotographic photosensitive member after the toner image is transferred, and (6) a step (hereinafter, referred to as a "pre-exposure step") of irradiating the surface of the electrophotographic photosensitive member from which the transfer residual toner has been removed, with destaticizing light (hereinafter, referred to as "pre-exposure") for eliminating residual charge on the surface of the electrophotographic photosensitive member.

In the image forming method, a surface layer of the electrophotographic photosensitive member contains a compound having a structure represented by formula (1) below in an amount of 0.1% to 10% by mass based on the total mass of the surface layer. When a charged region in which the electrostatic latent image is formed in the step (2) is referred to as an "image forming region" and a charged region in which the electrostatic latent image is not formed is referred to as a "non-image forming region.", the non-image forming region is not irradiated with the destaticizing light or is irradiated with the reduced destaticizing light in the step (6).

(1)

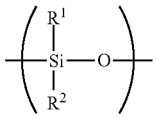

In the formula (1), $R^1$ and $R^2$ each independently represent a methyl group, an ethyl group, or a phenyl group.

As a result of investigation of the phenomenon increasing the torque of the electrophotographic photosensitive member when the electrophotographic photosensitive member has a higher circumferential speed, the inventors found that the phenomenon is caused by pre-exposure.

Pre-exposure is performed for eliminating residual charge of the surface of the electrophotographic photosensitive member by irradiating the surface of the electrophotographic photosensitive member with light. Therefore, the image history of a previous cycle can be erased by performing the pre-exposure before charging the surface of the electrophotographic photosensitive member, and thus the occurrence of an afterimage due to an image of a previous cycle can be suppressed.

On the other hand, the charge of the surface of the electrophotographic photosensitive member is eliminated by pre-exposure, and thus discharge occurs from a charging member to the electrophotographic photosensitive member when the surface of electrophotographic photosensitive member is then again charged. When the electrophotographic photosensitive member has a higher circumferential speed, the surface of the electrophotographic photosensitive member is repeatedly subjected to discharge, and thus the compound having a structure represented by the formula (1) is considered to more significantly deteriorate.

For the problem, in the present disclosure, in the pre-exposure step, the non-image forming region is not irradiated or is irradiated with light in a smaller quantity than that for irradiation of the image forming region in which the electrostatic latent image is formed. As a result, a high surface potential is maintained in the non-image forming region of the electrophotographic photosensitive member. Thus, when the surface of the electrophotographic photosensitive member is charged in the charging step, discharge from the charging member is suppressed in the non-image forming region. Therefore, the inventors consider that the compound having a structure represented by the formula (1) little deteriorates by discharge, and even when the electrophotographic photosensitive member has a higher circumferential speed, an increase in torque of the electrophotographic photosensitive member can be suppressed. Also, even when in the pre-exposure step, the non-image forming region is not irradiated with light or is irradiated with light in a smaller quantity than that for irradiation of the image forming region, it is not necessary to consider the influence of residual charge on an image on the surface of the electrophotographic photosensitive member.

In addition, from the viewpoint of suppressing an increase in torque of the electrophotographic photosensitive member, in the charged region of the surface of the electrophotographic photosensitive member charged in the charging step, the non-image forming region where the electrostatic latent image is not formed is not irradiated in the pre-exposure step.

In the present disclosure, "reducing light" represents reducing a quantity of light within the absorption wavelength region of the electrophotographic photosensitive member.

<Electrophotographic Photosensitive Member>

The configuration of the electrophotographic photosensitive member according to the present disclosure is described.

The electrophotographic photosensitive member according to the present disclosure includes a support and a photosensitive layer provided on the support. The photosensitive layer may be a single-layer-type photosensitive layer including a single layer or a laminated photosensitive layer including a laminate of a charge-generating layer and a charge-transport layer. In the present disclosure, the surface layer of the electrophotographic photosensitive layer may contain the compound having a structure represented by the formula (1). Therefore, when the photosensitive layer is the surface layer, the compound having a structure represented by the formula (1) is contained in the photosensitive layer, while when the charge-transport layer is the surface layer, the compound is contained in the charge-transport layer. In addition, a surface protecting layer may be further formed on the photosensitive layer. In this case, the compound having a structure represented by the formula (1) is contained in the surface protecting layer.

[Support]

The support preferably has conductivity (conductive support), and a support made of a metal such as aluminum, an aluminum alloy, stainless, or the like can be used. For the support made of aluminum or an aluminum alloy, an ED pipe, an EI pipe, or an ED or EI pipe subjected to cutting, composite electro-polishing, or wet or dry honing treatment can also be used. Further, a metal support or resin support coated with a layer formed by vacuum deposition of aluminum, an aluminum alloy, or an indium oxide-tin oxide alloy can also be used. Further, a support formed by impregnating a resin with conductive particles such as carbon black, tin oxide particles, titanium oxide particles, or silver particles, or plastic including a conductive binder resin can also be used.

The surface of the support may be subjected to cutting, coarsening, or alumite treatment, or the like.

[Conductive Layer]

A conductive layer may be provided between the support and an intermediate layer or the charge-generating layer described below. The conductive layer is formed by using a coating solution for a conductive layer, which contains conductive particles dispersed in a binder resin. Examples of the conductive particles include carbon black, acetylene black, metal powders of aluminum, nickel, iron, nichrome, copper, zinc, silver, and the like, and metal oxide powders of conductive tin oxide, ITO, and the like.

Examples of the binder resin include polyester resins, polycarbonate resins, polyvinylbutyral resins, acryl resin, silicone resins, epoxy resins, melamine resins, urethane resins, phenol resins, and alkyd resins.

Examples of a solvent of the coating solution for a conductive layer include ether solvents, alcohol solvents, ketone solvents, and aromatic hydrocarbon solvents.

The thickness of the conductive layer is preferably 0.2 μm or more and 40 μm or less, more preferably 1 μm or more and 35 μm or less, and still more preferably 5 μm or more and 30 μm or less.

[Intermediate Layer]

The intermediate layer may be provided between the support or the conductive layer and the charge-generating layer.

The intermediate layer can be formed by applying a coating solution for an intermediate layer, which contains a binder resin, on the conductive layer and then drying or curing the applied coating solution.

Examples of the binder resin in the intermediate layer include polyacrylic acids, methyl cellulose, ethyl cellulose, polyamide resins, polyimide resins, polyamide-imide resins, polyamide-acid resins, melamine resins, epoxy resins, polyurethane resins, acetal resins, and the like.

Also, the intermediate layer may contain an electron-transport material, and the electron-transport material is used as a mixture with a resin or used after being cured. In particular, the electron-transport material, a resin, and a cross-linking agent are cured and used from the viewpoint of improving the electric characteristics during repeated use.

The thickness of the intermediate layer is preferably 0.05 μm or more and 7 μm or less and more preferably 0.1 μm or more and 2 μm or less.

The intermediate layer may contain semiconductive particles, an electron-transport material, or an electron-accepting material.

[Charge-Generating Layer]

The charge-generating layer is provided on the support, the conductive layer, or the intermediate layer.

Examples of a charge-generating material used in the electrophotographic photosensitive member of the present disclosure include azo pigments, phthalocyanine pigments, indigo pigments, and perylene pigments. These charge-generating materials may be used alone or combination of two or more. Among these, metal phthalocyanine such as oxytitanium phthalocyanine, hydroxygallium phthalocyanine, or chlorogallium phthalocyanine is preferred because of high sensitivity.

Examples of a binder resin used in the charge-generating layer include polycarbonate resins, polyester resins, butyral resins, polyvinylacetal resins, acryl resins, vinyl acetate resins, and urea resins. Among these, butyral resins are preferred. These can be use alone or as a mixture or copolymer of two or more The charge-generating layer can be formed by applying a coating solution for a charge-generating layer, which is prepared by dispersing the charge-generating material, the binder resin, and a solvent, and then drying the resultant dispersion. The charge-generating layer may be a vapor-deposited film of the charge-generating material.

Examples of a dispersion method include methods using a homogenizer, ultrasonic waves, a ball mill, a sand mill, an attritor, and a roll mill.

The ratio of the charge-generating material to the binder resin is preferably in a range of 1:10 to 10:1 (ratio by mass) and more preferably in a range of 1:1 to 3:1 (ratio by mass).

The solvent used in the coating solution for a charge-generating layer is selected in view of the solubility and dispersion stability of the charge-generating material and the binder resin used. Examples of an organic solvent include alcohol solvents, sulfoxide solvents, ketone solvents, ether solvents, ester solvents, aromatic hydrocarbon solvents, and the like.

The thickness of the charge-generating layer is preferably 5 μm or less and more preferably 0.1 μm or more and 2 μm or less.

If required, any of various sensitizers, antioxidants, ultraviolet absorbers, plasticizers, and the like can be added to the charge-generating layer. Also, in order to prevent a charge flow from being interrupted in the charge-generating layer, the charge-generating layer may contain an electron-transport material or an electron-accepting material.

[Charge-Transport Layer]

A charge-transport layer is provided on the charge-generating layer.

When the charge-transport layer is the surface layer, the compound having a structure represented by the formula (1) is contained in an amount of 0.1% by mass to 10% by mass based on the total mass of the surface layer. With the amount of less than 0.1% by mass, the effect of decreasing the torque of the electrophotographic photosensitive member is insufficient, while with the amount exceeding 10% by mass, the durability of the charge-transport layer may deteriorate.

Examples of a material other than the compound having a structure represented by the formula (1) contained in the charge-transport layer include a charge-transport material, a binder resin, an antioxidant, an ultraviolet absorber, a plasticizer, and the like.

The charge-transport layer (surface layer) can include a resin having at least one structure selected from the group consisting of those of formulae (2) and (3) below.

(2)

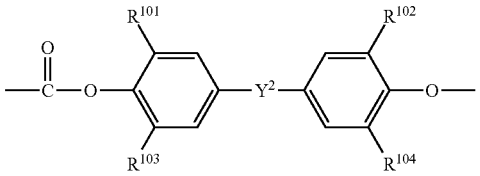

In the formula (2), $R^{101}$ to $R^{104}$ each independently represent a methyl group or an ethyl group, and $Y^2$ represents a single bond, a methylene group, an ethylidene group, a propylidene group, a phenylethyldene group, a cyclohexylidene, group, or an oxygen atom.

(3)

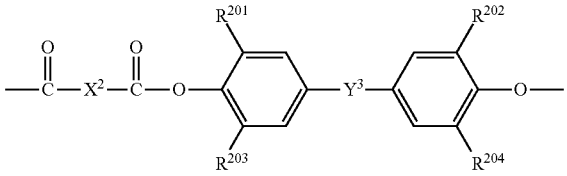

In the formula (3), $R^{201}$ to $R^{204}$ each independently represent a methyl group or an ethyl group, $Y^3$ represents a single bond, a methylene group, an ethylidene group, a propylidene group, a phenylethylidene group, a cyclohexylidene group, or an oxygen atom, and $X^2$ represents a phenylene group or a structure represented by formula (4) below.

(4)

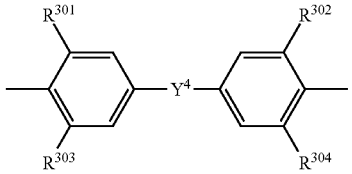

In the formula (4) $R^{301}$ to $R^{304}$ each independently represent a methyl group or an ethyl group, and $Y^4$ represents a single bond, a methylene group, an ethylidene group, a propylidene group, a phenylethylidene group, a cyclohexylidene group, or an oxygen atom.

From the viewpoint of durability and retention of the compound represented by the formula (1), $Y^2$ in the formula (2) is preferably a single bond.

Examples of the resin represented by the formula (2) are given below.

(2-1)

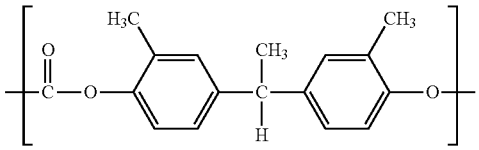

(2-2)

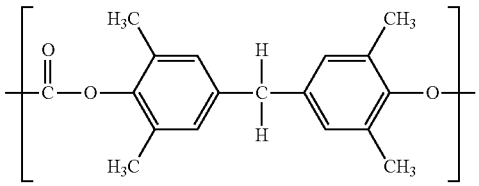

-continued (2-3)

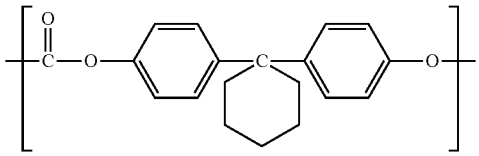

(2-4)

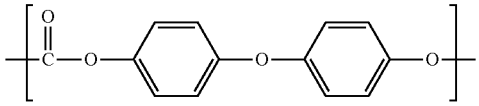

(2-5)

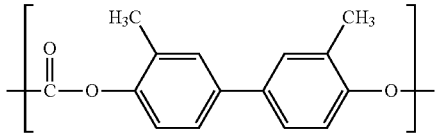

(2-6)

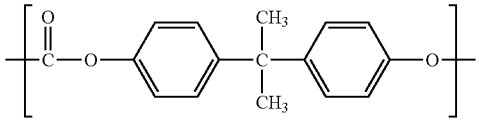

(2-7)

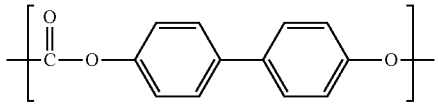

(2-8)

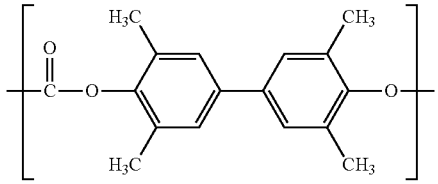

The resin represented by the formula (2) may have one or two or more of these structures.

In particular, the resin preferably has a structure represented by any one of the formulae (2-5), (2-7), and (2-8)

From the viewpoint of durability and retention of the compound represented by the formula (1), $Y^3$ in the formula (3) is preferably a single bond.

Examples of the resin represented by the formula (3) are given below.

(3-1)

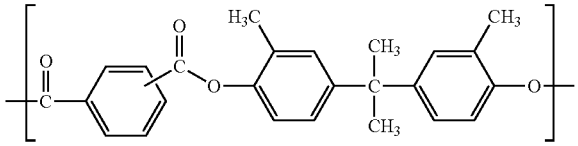

(3-2)

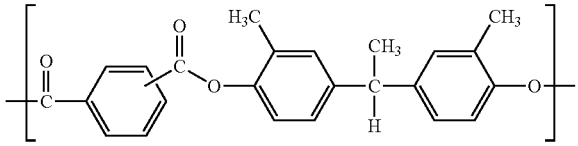

-continued
(3-3)
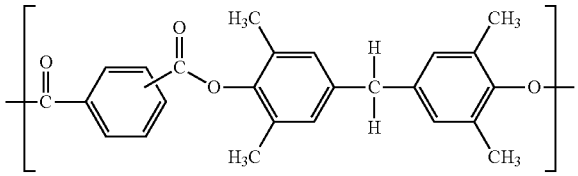
(3-4)
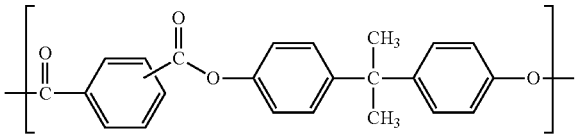
(3-5)
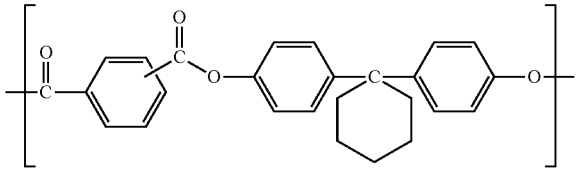
(3-6)
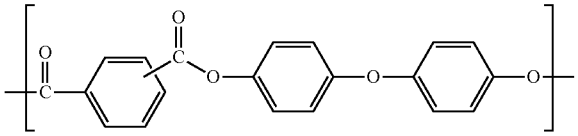
(3-7)
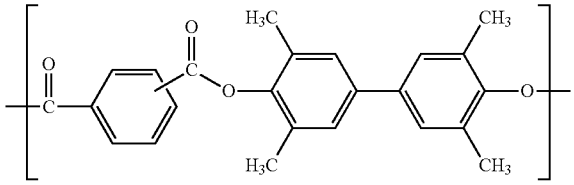
(3-8)
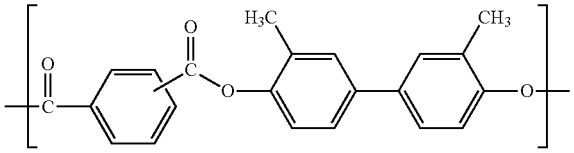
(3-9)
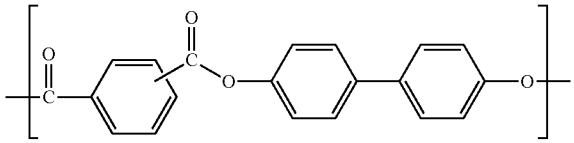
(3-10)
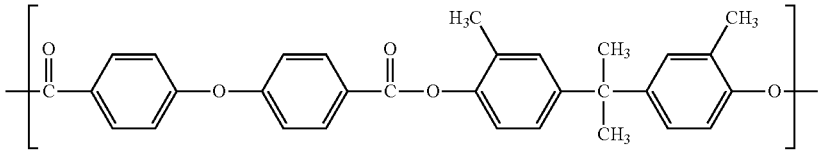
(3-11)
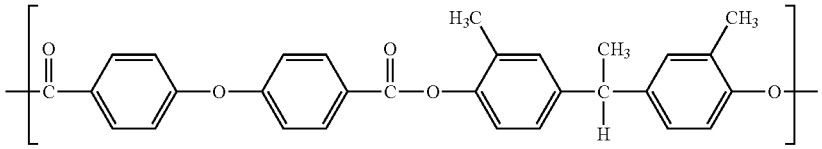
(3-12)
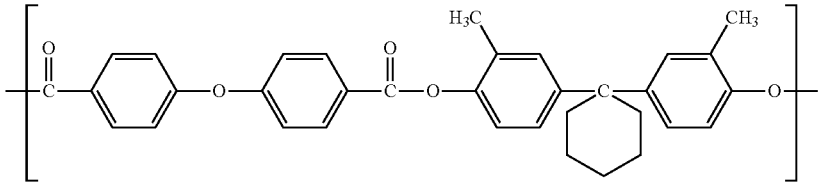

The resin represented by the formula (3) may have one or two or more of these structures.

In particular, the resin preferably has a structure represented by any one of the formulae (3-7), (3-8), and (3-9).

The resins represented by the formulae (2) and (3) may be used alone or two or more as the binder resin.

Examples of the compound represented by the formula (1) include silicone oil and resins having a siloxane structure.

In particular, the compound (resin) preferably has at least one structure selected from the group consisting of those represented by formulae (1-A), (1-B), (1-C), and (1-D) below.

(1-A)

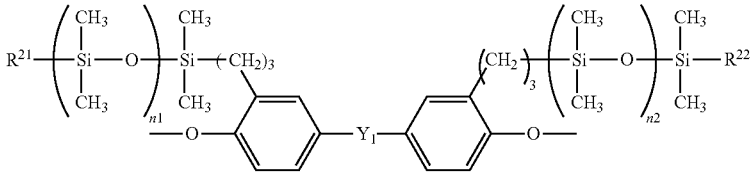

(1-B)

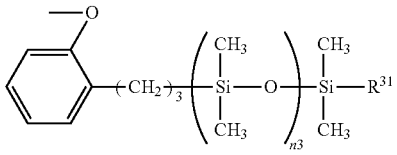

(1-C)

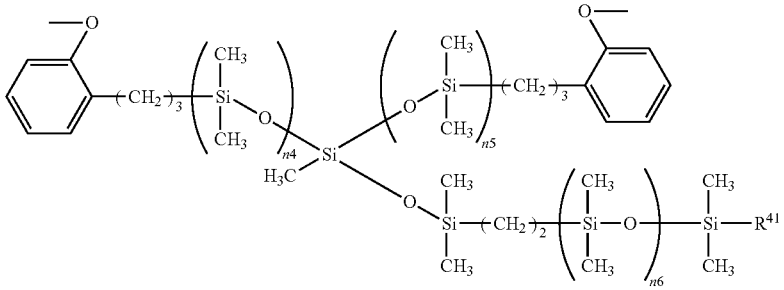

(1-D)

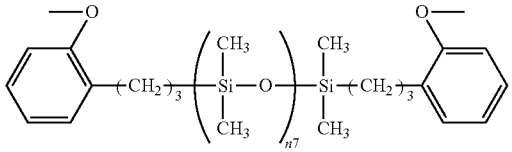

The charge-transport layer can be formed by applying a coating solution for a charge-transport layer, which is prepared by dissolving the materials in a solvent, and then drying the resultant solution.

The ratio (the charge-transport material:the binder resin) of the charge-transport material to the binder resin in the coating solution for a charge-transport layer is preferably in a range of 4:10 to 20:10 (ratio by mass) and more preferably in a range of 5:10 to 12:10 (ratio by mass).

Examples of the solvent used in the coating solution for a charge-transport layer include ketone solvents, ester solvents, ether solvents, and aromatic hydrocarbon solvents. These solvents may be used alone or as a mixture of two or more. Among these solvents, ether solvents or aromatic hydrocarbon solvents are preferably used from the viewpoint of resin solubility.

The thickness of the charge-transport layer is preferably 5 μm or more and 50 μm or less and more preferably 10 μm or more and 35 μm or less.

When the charge-transport layer is the surface layer, it is important for achieving the effect of the present disclosure that the charge-transport layer contains the compound having a structure represented by the formula (1)

In the formula (1-A), $Y^1$ represents a single bond, a methylene group, an ethylidene group, a propylidene group, a phenylethylidene group, a cyclohexylidene group, or an oxygen atom, $R^{21}$ and $R^{22}$ each independently represent a methyl group or an ethyl group, and n1 and n2 each independently represent an average number of repetitions of a structure in brackets and are each 20 or more and 200 or less.

In the formula (1-B), $R^{31}$ represents a methyl group, an ethyl group, a propyl group, or a butyl group, and n3 represents an average number of repetitions of a structure in brackets and is 20 or more and 200 or less.

In the formula (1-C), $R^{41}$ represents a methyl group or an ethyl group, and n4, n5, and n6 each independently represent an average number of repetitions of a structure in brackets and are each 20 or more and 200 or less.

In the formula (1-D), n7 represents an average number of repetitions of a structure in brackets and is 20 or more and 200 or less.

Examples of a resin represented by the formula (1-A) are given below.

(1-A-1)
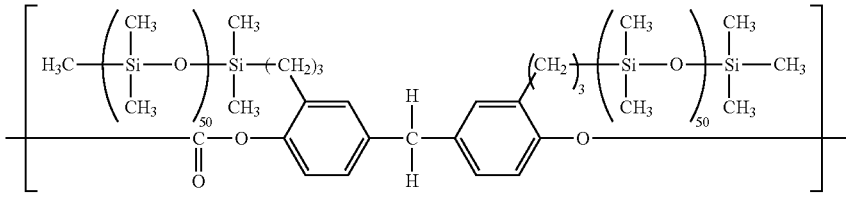
(1-A-2)
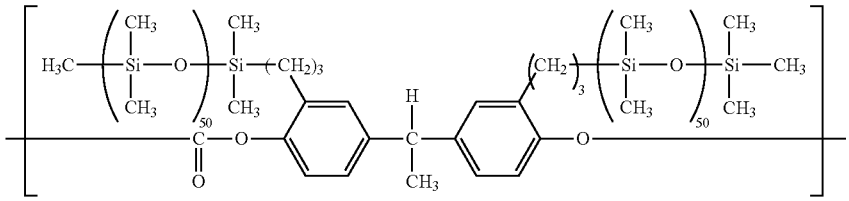
(1-A-3)
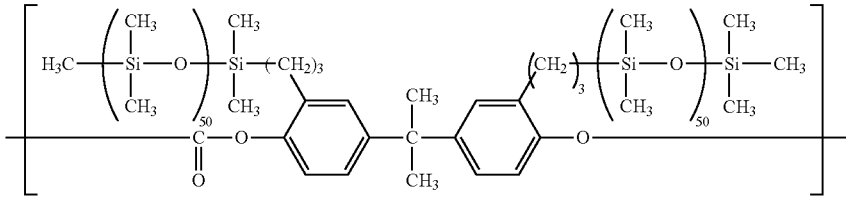
(1-A-4)
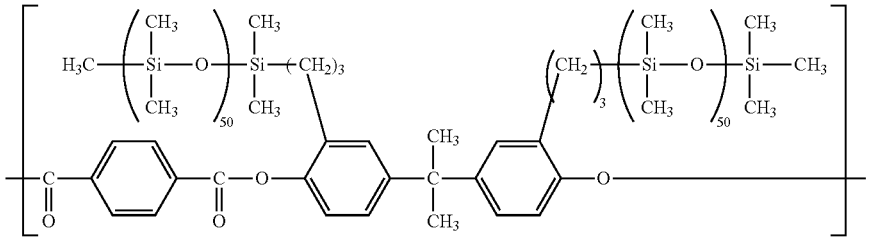
Examples of a resin represented by the formula (1-B) are given below.
(1-B-1)
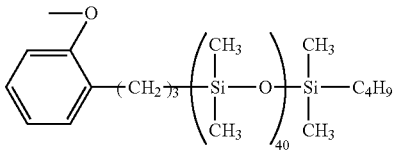
Examples of a resin represented by the formula (1-C) are given below.
(1-C-1)
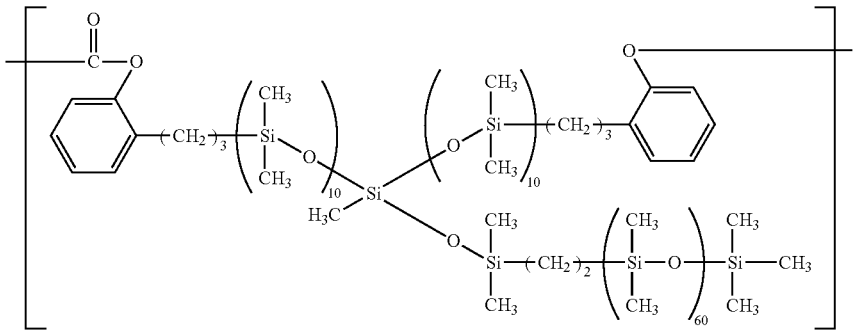

-continued
(1-C-2)
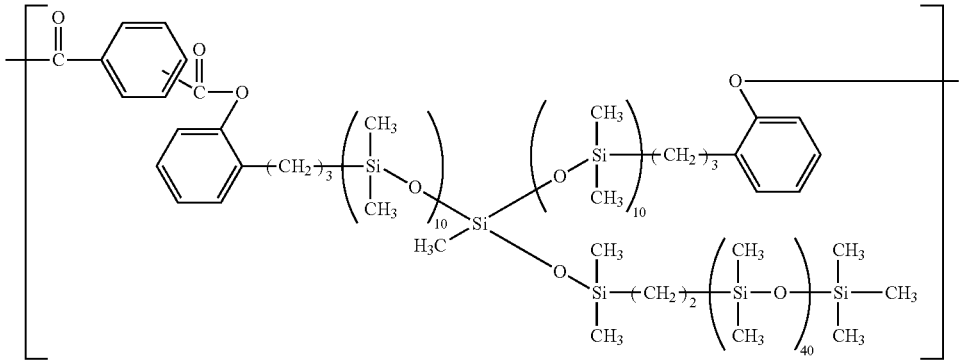
Examples of a resin represented by the formula (1-D) are given below.
(1-D-1)
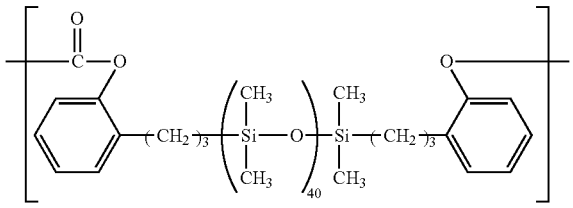
The compound represented by the formula (1) may have a structure represented by any one of formulae (1-E-1) to (1-E-14) below together with the structure represented by any one of the formulae (1-A), (1-B), (1-C), and (1-D).
(1-E-1)
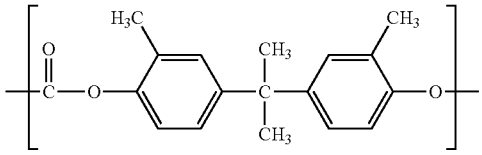
(1-E-2)
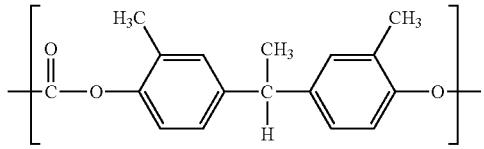
(1-E-3)
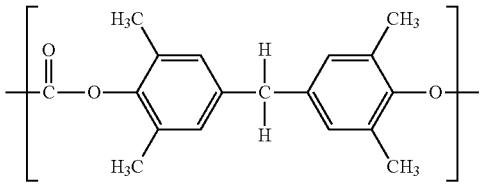
(1-E-4)
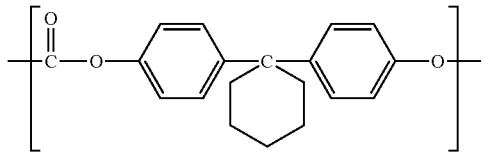
(1-E-5)
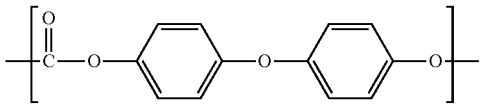
(1-E-6)
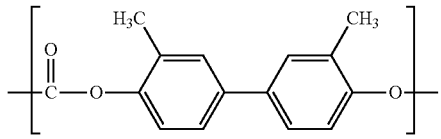
(1-E-7)
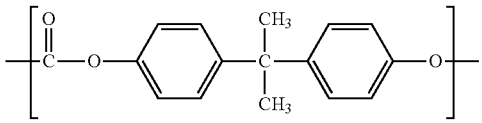
(1-E-8)
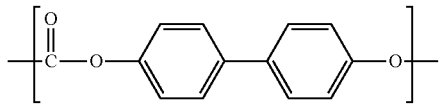

-continued (1-E-9)

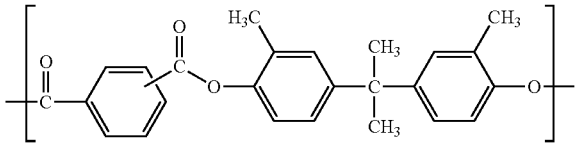

(1-E-10)

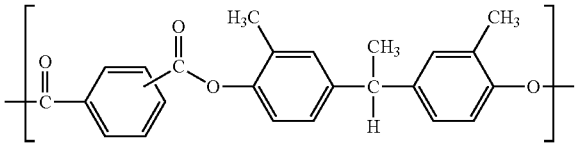

(1-E-11)

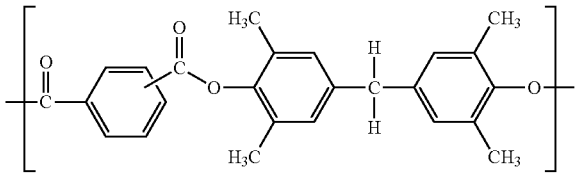

(1-E-12)

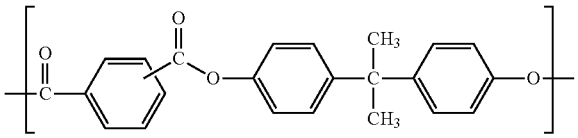

(1-E-13)

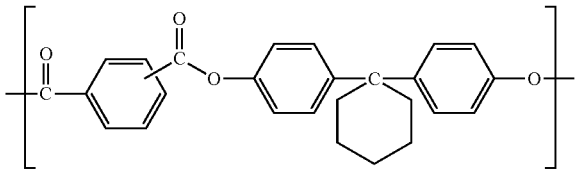

(1-E-14)

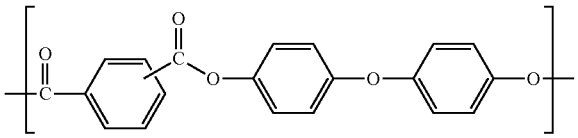

(1-E-15)

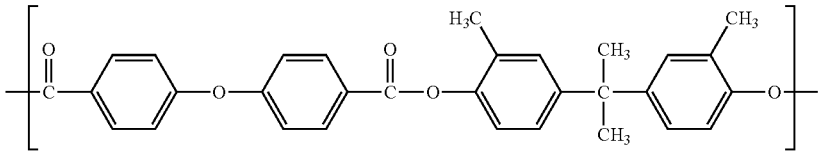

In particular, the compound represented by the formula (1) preferably has a structure represented by the formula (1-B) or the formula (1-D). Further, in order to exhibit the effect of decreasing torque, the compound preferably has a structure represented by the formula (1-B-1), a structure represented by the formula (1-D-1), and a structure represented by any one of the formula (1-E-1) to the formula (1-E-15).

In particular, the compound represented by the formula (1) preferably has a combination of a structure represented by the formula (1-B-1), a structure represented by the formula (1-D-1), and a structure represented by the formula (1-E-1).

The average, number of repetitions of a structure represented by the formula (1) in the resin can be properly changed but is more preferably 30 or more.

The weight-average molecular weight (Mw) of the compound represented by the formula (1) is preferably 5,000 or more and 500,000 or less. When the weight-average molecular weight (Mw) of the compound represented by the formula (1) is within the range, deterioration due to discharge from the charging member can be suppressed, and the torque of the electrophotographic photosensitive member can be further decreased from an initial stage of printing.

In the present disclosure, the weight-average molecular weight of the resin is a weight-average molecular weight in terms of polystyrene measured by a method described in Japanese Patent Laid-Open No. 2007-79555 according to a usual method.

In the present disclosure, for example, in the case of a repeat structural unit represented by formula (1-S) below, the structure represented by the formula (1) represents a part surrounded by a broken line below.

(1-S)

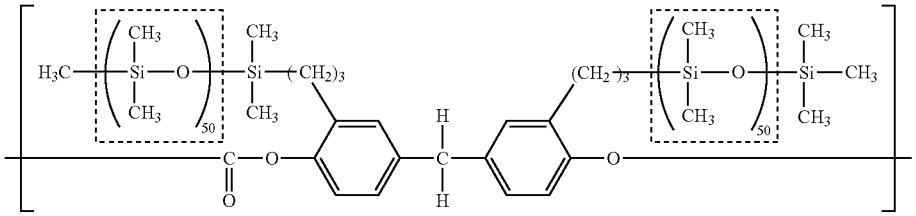

The resin can be synthesized by a known phosgene method or ester exchange method using bisphenol, or a known polymerization method using bisphenol and a dicarboxylic acid.

The content of the structure represented by the formula (1) in the formula (1-S) can be analyzed by a general analytical method. An example of the analytical method is described below.

The surface layer (for example, the charge-transport layer) of the electrophotographic photosensitive member is dissolved in a solvent, and the various materials contained in the charge-transfer layer serving as the surface layer are fractionated by a fractionating apparatus capable of separating and recovering composition components, such as a size exclusion chromatography, high-performance liquid chromatography, or the like. The constituent material structure and content of the resin, which is fractionated component [α], can be confirmed by a peak position of hydrogen atoms (hydrogen atoms constituting the resin) and a conversion method using a peak area ratio in $^{1}$H-NMR measurement. By using the results, the number of repetitions and molar ratio of a part represented by the formula (1) can be calculated and converted to the content (ratio by mass).

The content of the structure represented by the formula (1) in the compound having the structure represented by the formula (1) is preferably 10% by mass or more and 90% by mass or less and more preferably 50% by mass or more and 90% by mass or less. When the content of the structure represented by the formula (1) is within the range, compatibility with the resin other than the compound represented by the formula (1) and contained in the charge-transfer layer is further improved while the torque of the electrophotographic photosensitive member is further decreased.

[Surface Protecting Layer]

The surface protecting layer may be provided on the charge-transport layer. However, in order to achieve the effect of the present disclosure, it is important that the surface layer contains the compound having a structure represented by the formula (1) in an amount of 0.1% by mass to 10% by mass based on the total mass of the surface layer. With the amount of less than 0.1% by mass, the effect of decreasing the torque of the electrophotographic photosensitive member is insufficient, while with the amount exceeding 10% by mass, the durability of the surface protecting layer may deteriorate.

<Process Cartridge, Electrophotographic Apparatus, and Image Forming Method>

A process cartridge, an electrophotographic apparatus, and an image forming method are described.

FIG. 1 shows a schematic configuration of an electrophotographic apparatus including a process cartridge provided with the electrophotographic photosensitive member according to the present disclosure.

An image forming apparatus 100 is a tandem-type full-color laser printer (multicolor image forming apparatus).

Y, N, C, and Bk denote first to fourth four image forming stations which form toner images of yellow, magenta, cyan, and black, respectively, corresponding to the separated component colors of a full-color image, and are disposed in parallel in order from below in the vertical direction in the body of the image forming apparatus.

Each of the image forming stations Y, N, C, and Bk has a movable (rotatable) drum-shaped electrophotographic photosensitive member 1 (a to d) serving as an electrostatic latent image carrier. Also, each of the image forming stations Y, M, C, and Bk has a charging device 2 (a to d) which is in contact with the electrophotographic photosensitive member 1 and uniformly charges the surface thereof. Further, each of the image forming stations Y, M, C, and Bk has an exposure device 3 (a to d) which forms an electrostatic latent image by image exposure of the surface of the electrophotographic photosensitive member 1 uniformly charged. Further, each of the image forming stations Y, M C, and Bk has a development device 4 (a to d) which develops, as a toner image, the electrostatic latent image formed on the surface of the electrophotographic photosensitive member 1 by using a developer (hereinafter referred to as a "toner"). Further, each of the image forming stations Y, M C, and Bk has a cleaning device 6 (a to d) which cleans the surface of the electrophotographic photosensitive member 1 after the toner image is transferred to a transfer medium (recording medium or transfer material) S.

The charging device 2 is a charging roller serving as a contact charging member (conductive member) disposed in contact with the electrophotographic photosensitive member 1. The exposure unit 3 is a laser scanner unit. The exposure device 3 exposures by scanning the uniformly charged surface of the electrophotographic photosensitive member 1 with a output laser beam modulated according to electrical image information input to a control circuit part (not shown) of the image forming apparatus from an external host device (not shown) such as a personal computer. Consequently, an electrostatic latent image corresponding to a scan exposure pattern is formed on the electrophotographic photosensitive member 1. The exposure device 3 is disposed in the horizontal direction of the electrophotographic photosensitive member 1 and includes a laser diode (not shown), a scanner motor (not shown), a polygon mirror 9 (a to d), and an imaging lens 10 (a to d).

Reference numeral 5 denotes a transfer unit which transfers the toner image formed on the electrophotographic photosensitive member 1 (a to d) to the transfer medium S. The transfer unit 5 includes an endless transfer belt 11 which is circularly moved so as to face and be in contact with all electrophotographic photosensitive members 1 (a to d) and which is stretched over four rollers including a drive roller 13, two driven rollers 14*a* and 14*b*, and a tension roller 15 and is disposed in the longitudinal direction. Reference numeral 12 (a to d) is a transfer roller serving as a transfer device and disposed in parallel in contact with the inner surface of the transfer belt 11 so that the transfer belt 11 is held between the electrophotographic photosensitive member 1 and the transfer roller 12. That is, the high-resistance sponge roller 12 (a to d) serving as the transfer device is disposed in parallel in contact with the inner surface of the transfer belt 11 at position facing to each of the four electrophotographic photosensitive members 1*a*, 1*b*, 1*c*, and 1*d*.

Reference numeral 16 denotes a transfer medium feeding part disposed below the apparatus body of the image forming apparatus so as to feed the transfer medium S to the transfer belt 11 of the transfer unit 5. The feeding part 16 includes a feeding cassette 17 in which a plurality of transfer media S are contained. Reference numeral 18 denotes a feeding roller semicircular roller), reference numeral 19 denotes a resist roller, and reference numeral 22 denotes an electrostatic attraction roller.

Reference numeral 20 denotes a fixing part disposed in an upper portion in the apparatus body of the image forming apparatus so as to fix a plurality of color toner images transferred to the transfer medium S. The fixing part 20 includes a rotating heating roller 21*a*, a pressure roller 21*b* which is in contact with the heating roller 21*a* and applies pressure to the transfer medium S, a pair of delivery rollers 23, a delivery port 24, etc. Reference numeral 25 denotes a delivery tray provided in an upper portion of the body of the image forming apparatus.

An operation for forming a full-color image is as follows. The image forming stations Y, M, C, and Bk are sequentially driven with predetermined control timing of an image forming sequence and the electrophotographic photosensitive members 1 are rotatively driven at a predetermined speed in the counterclockwise direction shown by an arrow. Also, the transfer belt 11 is driven to be circularly moved by the drive roller 13 at a speed corresponding to the rotational speed of the electrophotographic photosensitive members 1 in a clockwise direction shown by an arrow.

The outer peripheral surface (surface) of each of the electrophotographic photosensitive members 1 is uniformly primarily charged to predetermined polarity (in this example, negative polarity) and potential by the charging roller 2 in a rotation process of the electrophotographic photosensitive member 1. The charged surface is subjected to image scanning exposure with a laser beam modulated according to image information output from the exposure device 3, thereby forming an electrostatic latent image of the image information on the surface of the electrophotographic photosensitive member 1. That is, an image beam corresponding to an image signal is output from the laser diode (not shown) of the exposure device 3, and the polygon mirror 9 rotated at a high speed by the scanner motor (not shown) is irradiated with the image beam. The charged surface of the electrophotographic photosensitive member 1 is selectively exposed to the image beam reflected by the polygon mirror 9 through the imaging lens 10. As a result, the electrostatic latent image is formed on the surface of the electrophotographic photosensitive member 1.

The electrostatic latent image is developed by the development unit 4 to form a toner image. In this example, reversal development is performed using a toner with negative polarity. Consequently, a toner image of each of the yellow, magenta, cyan, and black colors, which is a separated color component image of the full-color image, is formed by an electrophotographic process on the surface of the electrophotographic photosensitive member of each of the image forming stations Y, M, C, and Bk with the predetermined sequence control timing.

On the other hand, the feeding roller 18 of the feeding part 16 is rotatively driven with the predetermined control timing. Thus, each of the transfer media S in the cassette 17 is separated and fed. At this time, the leading end of the transfer medium S hits a nip part of the resist roller pair 19 in a rotation stop state and is caught and stopped temporarily by the nip part. Then, the resist roller pair 19 is rotatively driven in synchronism between the rotation of the transfer belt 11 and the toner image formed on the electrophotographic photosensitive member 1. Consequently, the transfer medium S is fed between the electrostatic attraction roller 22 and the transfer belt 11. The feeding part 16 feeds the transfer medium S to the image forming part and includes the cassette 17 in which a plurality of transfer media S are contained. When an image is formed, the feeding roller 18 and the resist roller pair 19 are rotatively driven according to an image forming operation to separate and feed each of the transfer media S in the cassette 17. The leading end of the fed transfer medium S hits the resist roller pair 19 and is stopped temporarily to form a loop, and is then fed to the transfer belt 11 by the resist roller pair 19 in synchronism between the rotation of the transfer belt 1 and the image writing position. The transfer medium S is held between the electrostatic attraction roller 22 and the transfer belt 11 and comes in contact with the outer peripheral surface of the transfer belt 11. When a voltage is applied between the transfer belt 11 and the electrostatic attraction roller 22, charge is induced in the transfer medium S serving as a dielectric material and in a dielectric layer of the transfer belt 11. Thus, the transfer medium S is electrostatically attracted to the surface of the electrostatic transfer belt 11. Therefore, the transfer medium S is stably attracted to the transfer belt 11 and is conveyed by movement of the transfer belt 11 from the most-upstream transfer part to the most-downstream transfer part in the movement direction of the transfer belt 11.

During conveyance of the transfer medium S, the toner images of the electrophotographic photosensitive members 1 are sequentially superimposed and transferred on the transfer medium. S by an electric field formed between the electrophotographic photosensitive member 1 and the transfer roller 12 in each of the image forming stations Y, M, C, and Bk. In the example, charge with positive polarity is applied to the transfer medium S from the transfer roller 12 through the transfer belt 11. Then, the toner image with negative polarity on the electrophotographic photosensitive member 1 is transferred to the transfer medium S being in contact with the electrophotographic photosensitive member 1 by an electric field due to the charge.

That is, the transfer medium S is electrostatically attracted to the surface of the transfer belt 11 and is conveyed vertically by rotation of the transfer belt 11. In the conveyance process, the toner images of yellow, magenta, cyan, and black formed on the surfaces of the electrophotographic photosensitive members 1 are sequentially superimposed and transferred in the transfer parts of the image forming stations Y, M, C, and Bk. As a result, an unfixed full-color toner image is synthesized and formed on the surface of the transfer medium S.

The transfer medium S to which the four-color toner image has been superimposed and transferred is curvedly separated from the transfer belt 11 at the position of the drive roller 13 and is conveyed to the fixing part 20. The transfer medium S is sandwich-conveyed by a nip part (fixing nip part) formed by the rotating heating roller 21*a* and the pressure roller 12*b* in contact with the heating roller 21*a*. Therefore, heat and pressure are applied to the transfer medium S by the roller pair 21*a* and 21*b* and the toner image of a plurality of colors is heat-fixed to the surface of the transfer medium S. After the toner image is fixed by the fixing part 20, the transfer medium S is delivered to the delivery tray 25 by the delivery roller pair 23 through the delivery part 24.

In each of the image forming stations Y, M, C, and Bk, after the toner image is transferred to the transfer medium. 5, remaining adhesion substances such as the transfer residual toner on the surface of the electrophotographic photosensitive member 1 are removed by the cleaning member 6 and image formation is repeatedly performed.

Figure 2:
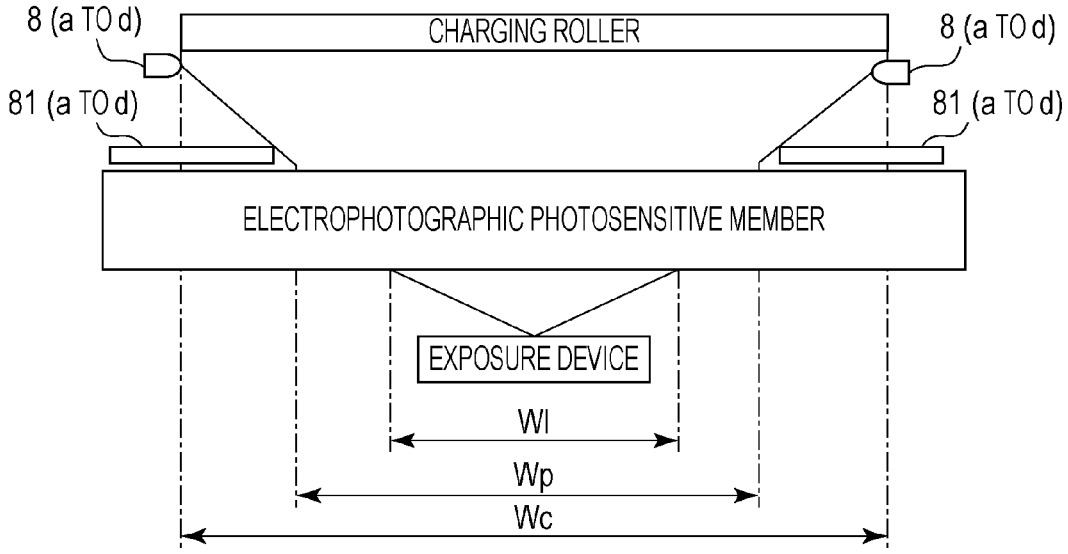
FIG. 2 is a drawing showing a positional relation between a charged region charged by a charging unit (charging roller), a pre-exposed region pre-exposed by a pre-exposure device, and an exposed region exposed by an exposure device in the longitudinal direction of an electrophotographic photosensitive member according to the present disclosure.

FIG. 2 is a drawing showing a positional relation between a charged region charged by a charging unit (charging roller), a pre-exposed region pre-exposed by a pre-exposure device, and an exposed region exposed by an exposure device in the longitudinal direction of an electrophotographic photosensitive member according to the present disclosure, in the present disclosure, the pre-exposure device is referred to as the "static elimination unit" or "pre-exposure unit".

In each of the image forming stations Y, M, C, and Bk, a pre-exposure device 8 (a to d) which irradiates the surface of the electrophotographic photosensitive member 1 with light from the outside in the longitudinal direction of the electrophotographic photosensitive member 1 is disposed for eliminating the surface potential of the electrophotographic photosensitive member 1 after transfer and before charging. In FIG. 2, the pre-exposure device 8 is disposed on each of the ends in the longitudinal direction of the electrophotographic photosensitive member 1. Although, in the example, the pre-exposure device 8 uses a red diode, the present disclosure is not limited to this. The pre-exposure device 8 controls the surface potential of the electrophotographic photosensitive member 1 by exposing the entire surface of the electrophotographic photosensitive member 1 with light after transfer. Also, in order to shield or reduce pre-exposure, a member 81 (a to d) is disposed at each of the ends of the charging roller so as to be arranged on the irradiation optical path from the pre-exposure device 8 to the electrophotographic photosensitive member 1. That is, each of the members 81 shields the optical path from the pre-exposure device 8 to surface of the electrophotographic photosensitive member 1 so as to prevent overlap between the discharge region end of the charging roller 2 and the irradiation region of the surface of the electrophotographic photosensitive member 1. The member disposed for shielding or reducing pre-exposure prevents the non-image forming region from being irradiated with light. Alternatively, the non-image forming region can be irradiated with the light in a quantity smaller than that of light irradiating the image-forming region. The transfer residual toner remaining on the surface of the electrophotographic photosensitive member 1 after pre-exposure and transfer is removed by the cleaning device 6.

In FIG. 2, W1 represents an electrostatic latent image formation width (electrostatic latent image forming region) in the longitudinal direction of the surface of the electrophotographic photosensitive member 1 on which the electrostatic latent image is formed by the exposure device 3. This region corresponds to the image forming region according to the present disclosure. Wc represents a charging width (charging region) in the longitudinal direction of the electrophotographic photosensitive member 1 charged by the charging roller 2 serving as the charging unit in a charging step. Wp represents an exposure width (pre-exposure region) in the longitudinal direction of the surface of the electrophotographic photosensitive member 1 irradiated with destaticizing light, in which pre-exposure from the pre-exposure devices 8 is neither shielded nor reduced by the members 81. The members 81 are disposed for shielding the light from the pre-exposure device 8 so as to satisfy Wc>Wp>W1.

The members 81 for shielding or reducing pre-exposure may be provided on any one of the process cartridge and the electrophotographic photosensitive member 1. In particular, the members 81 are preferably provided on the process cartridge because light from the pre-exposure devices can be shielded at a position close to the electrophotographic photosensitive member 1 and light reflected from the surrounding members can also be shielded.

Each of the members 81 for shielding or reducing pre-exposure according to the present disclosure may be a member which shields or reduces light (pre-exposure) from the pre-exposure device 8, but is preferably a member which shields the light in order to maintain a high surface potential in the non-image forming region. The expression "shields light" represents that light is not transmitted.

Other than the method using the member for shielding the light irradiating from the pre-exposure devices 8 as described above, for example, a method for preventing the non-image forming region from being irradiated with light using a laser beam for pre-exposure can be used as a method for preventing the non-image forming region from being irradiated with light. However, it is more preferred to provide the member for shielding pre-exposure because a laser beam oscillator for oscillating the laser beam makes it difficult to miniaturize the image forming apparatus or the process cartridge body.

In addition, any one of various materials capable of shielding or reducing pre-exposure can be used as the member for shielding or reducing pre-exposure. In particular, in view of further suppressing an increase in torque of the electrophotographic photosensitive member 1, the quantity of pre-exposure light irradiating' per unit area of the image-forming region of the electrophotographic photosensitive member 1 is preferably reduced by 50% or more, more preferably 90% or more.

The cleaning device is not particularly limited as long as the device removes the transfer residual toner from the surface of the electrophotographic photosensitive member 1 after the toner image is transferred. A device which removes the transfer residual toner by rubbing the surface of the electrophotographic photosensitive member 1 with a blade is generally used.

In addition, it is supposed that the effect of the present disclosure can be easily achieved by suppressing a surface potential difference between before and after charging in the non-image forming region of the electrophotographic photosensitive member 1, and a surface potential difference between before and after charging of the electrophotographic photosensitive member 1 is preferably 200 V or less.

In order that a surface potential difference between before and after charging of the electrophotographic photosensitive member 1 is 200 V or less, specifically, it is preferred to provide a unit which does not apply transfer or a unit which controls a transfer voltage and transfer current value to a predetermined value or less in the non-mage forming region.

Examples of the unit that controls a transfer voltage and transfer current value include a constant-current control unit which controls the value by changing an applied voltage.

In this case, the transfer current value during image formation is preferably 20 μA or less, and the applied voltage is preferably about 2000 V or less for controlling a surface potential difference between before and after charging of the electrophotographic photosensitive member to 1 to 200 V or less. The circumferential speed of the electrophotographic photosensitive member is not particularly limited but is preferably 250 mm/sec or more from the viewpoint of miniaturizing and speeding-up an electrophotographic apparatus.

The process cartridge of the present disclosure may be configured to be detachable from the body of an electrophotographic apparatus such as a copying machine, a laser beam printer, or the like.

EXAMPLES

The present disclosure is described in further detail below by giving examples and comparative examples. However, the present disclosure is not limited to these examples. In the examples, "parts" represents "parts by mass".

[Photosensitive Member Production Example 1]

An aluminum cylinder having a diameter of 24 mm and a length of 261.5 mm was used as a support.

Next, 214 parts of titanium oxide ($TiO_2$) particles coated with oxygen deficient tin oxide ($SnO_2$) and serving as metal oxide particles, 132 parts of phenol resin (monomer/oligomer of phenol resin) (trade name: Plyorphen J-325, manufactured by DIC Corporation, resin solid content: 60% by mass) as a binder material, and 98 parts of 1-methoxy-2-propanol as a solvent were placed in a sand mill using 450 parts of glass beads having a diameter of 0.8 mm and then dispersed under the conditions including a rotational speed of 2000 rpm, a dispersion time of 4.5 hours, and a cooling water set temperature of 18° C. to prepare a dispersion.

The glass beads were removed from the dispersion by using a mesh (opening: 150 μm).

Then, silicone resin particles were added as a surface roughness imparting material to the dispersion so that the amount was 10% by mass relative to the total mass of the metal oxide particles and the binder material in the dispersion from which the glass beads had been removed. The silicone resin was Tospearl 120 (trade name) manufactured by Momentive Performance Materials Inc. and having an average particle diameter of 2 μm. In addition, silicone oil (trade name: SH28PA, manufactured by Toray Dow-Corning Corporation) was added to the dispersion so that the amount was 0.01% by mass relative to the total mass of the metal oxide particles and the binder material in the dispersion. Then, the dispersion to which the silicone resin particles and the silicone oil had been added was stirred to prepare a coating solution for a conductive layer. The coating solution for a conductive layer was applied to the support by dipping, and the resultant coating film was dried and heat-cured at 150° C. for 30 minutes to form a conductive layer having a thickness of 30 μm on the support.

Next, 8.5 parts of a compound represented by formula (5) below as a charge transport material, (5)

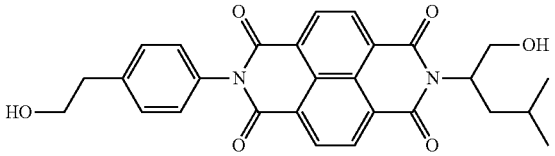

15 parts of a blocked isocyanate compound (trade name: SBN-70D, manufactured by Asahi Kasei Chemicals Corporation), 0.97 parts of a polyvinyl alcohol resin (trade name: KS-5Z, manufactured by Sekisui Chemical Co., Ltd.) as a resin, and 0.15 parts of zinc(II) hexanoate (trade name: zinc(II) hexanoate, manufactured by Mitsuwa Chemicals Co., Ltd.) as a catalyst were dissolved in a mixed solvent of 88 parts by 1-methoxy-2-propanol and 88 parts of tetrahydrofuran to prepare a coating solution for an intermediate layer. The coating solution for an intermediate layer was applied to the conductive layer by dipping, and the resultant coating film was heated and cured (polymerized) at 170° C. for 20 minutes to form an intermediate layer having a thickness of 0.7 μm on the conductive layer.

Next, 10 parts of crystalline hydroxygallium phthalocyanine (charge-generating material) having strong peaks at the Bragg angles (2θ±0.2°) of 7.5°, 9.9°, 16.3°, 18.6°, 25.1°, and 28.3° in CuKα characteristic X-ray diffraction was prepared. The charge-generating material was mixed with 250 parts of cyclohexanone and 5 parts of polyvinyl butyral resin (trade name: S-LEC BX-1, manufactured by Sekisui Chemical Co., Ltd.) and dispersed in a sand mill apparatus using glass beads having a diameter of 1 mm in an atmosphere of 23° C.±3° C. for 1 hour. After dispersion, 250 parts of ethyl acetate was added to the resultant dispersion to prepare a coating solution for a charge-generating layer. The coating solution for a charge-generating layer was applied to the intermediate layer by dipping and then dried at 100° C. for 10 minutes to form a charge-generating layer having a thickness of 0.26 μm on the intermediate layer.

Next, materials below were dissolved in a mixed solvent of 70 parts of tetrahydrofuran and 40 parts of toluene to prepare a coating solution for a charge-transport layer.

As a compound having a structure represented by the formula (1), 1 part of a compound (weight-average molecular weight (Mw): 50,000) having structures represented by the formula (1-D-1) and the formula (1-A-3) at a mass ratio of 60:20

As a charge-transport material, 10 parts of a compound represented by formula (6) below (6)

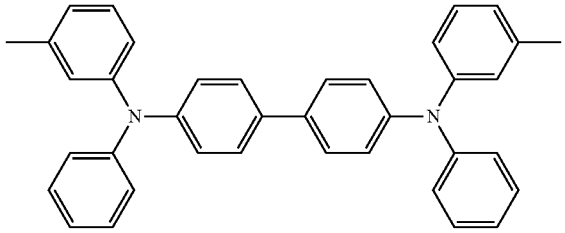

As a binder resin, 10 parts of a compound (weight-average molecular weight (Mw): 20,000) represented by the formula (2-5)

The coating solution for a charge-transport layer was applied to the charge-generating layer by dipping and then dried at 120° C. for 30 minutes to form a charge-transport layer having a thickness of 20 μm on the charge-generating layer.

[Photosensitive Member Production Examples 2 to 16]

A photosensitive member was produced by the same method as in the photosensitive member production example 1 except that the compound contained in the charge-transport layer of the photosensitive member production example 1 was changed as shown in Table 1.

TABLE 1

| | Compound represented by formula (1) | | | | Binder resin | | | Content of compound |
|---|---|---|---|---|---|---|---|---|
| | Structure | Terminal | Mw | Parts | Structure | Mw | Parts | represented by (1) |
| Photosensitive member production example 1 | (1-E-1)/(1-A-3) = 60/20 | — | 50,000 | 1 | (2-5) | 40,000 | 10 | 4.8% |
| Photosensitive member production example 2 | (1-E-1a) | (1-B-1) | 12,000 | 1 | (2-5) | 40,000 | 10 | 4.8% |
| Photosensitive member production example 3 | (1-E-1)/(1-D-1) = 50/50 | (1-B-1) | 40,000 | 1 | (2-5)/(2-1) = 30/70 | 55,000 | 10 | 4.8% |

TABLE 1-continued

| | Compound represented by formula (1) | | | | Binder resin | | | Content of compound |
|---|---|---|---|---|---|---|---|---|
| | Structure | Terminal | Mw | Parts | Structure | Mw | Parts | represented by (1) |
| Photosensitive member production example 4 | (1-C-1) | — | 80,000 | 1 | (2-5) | 40,000 | 10 | 4.8% |
| Photosensitive member production example 5 | (1-E-3)/(1-A-4) = 70/30 | — | 100,000 | 1 | (2-5) | 40,000 | 10 | 4.8% |
| Photosensitive member production example 6 | (1-E-1)/(1-D-1) = 50/50 | (1-B-1) | 40,000 | 1 | (2-3) | 20,000 | 10 | 4.8% |
| Photosensitive member production example 7 | Dimethylsilicone oil | — | 60,000 | 0.05 | (2-3) | 20,000 | 10 | 0.2% |
| Photosensitive member production example 8 | (1-E-14)/(1-A-4) = 80/20 | — | 80,000 | 1 | (2-5) | 40,000 | 10 | 4.8% |
| Photosensitive member production example 9 | (1-E-12)/(1-C-2) = 30/70 | — | 150,000 | 1 | (2-5) | 40,000 | 10 | 4.8% |
| Photosensitive member production example 10 | (1-E-2) | (1-B-1) | 12,000 | 1 | (3-8) | 60,000 | 10 | 4.8% |
| Photosensitive member production example 11 | (1-E-1)/(1-A-3) = 60/20 | — | 50,000 | 0.1 | (2-5) | 40,000 | 10 | 0.5% |
| Photosensitive member production example 12 | (1-E-1)/(1-A-3) = 60/20 | — | 50,000 | 2.2 | (2-5) | 40,000 | 10 | 9.9% |
| Photosensitive member production example 13 | (1-E-1)/(1-D-1) = 50/50 | (1-B-1) | 20,000 | 1 | (2-5)/(2-1) = 30/70 | 55,000 | 10 | 4.8% |
| Photosensitive member production example 14 | Dimethylsilicone oil | — | 60,000 | 2.2 | (2-3) | 20,000 | 10 | 9.9% |
| Photosensitive member production example 15 | | No | | 0 | (2-5) | 40,000 | 10 | 0.0% |
| Photosensitive member production example 16 | | No | | 0 | (3-8) | 60,000 | 10 | 0.0% |
| Photosensitive member production example 17 | (1-E-4)/(1-D-1) = 50/50 | (1-B-1) | 40,000 | 1 | (2-3) | 40,000 | 10 | 4.8% |
| Photosensitive member production example 18 | (1-E-4)/(1-D-1) = 50/50 | (1-B-1) | 40,000 | 1 | (3-1)/(3-7) = 70/30 | 120,000 | 10 | 4.8% |

In Table 1, for example, "(1-E-1)/(1-A-3)=60/20" represents a mass ratio of the structures in a compound represented by the formula (1).

In Table 1, the content of the compound represented by the formula (1) is shown by "% by mass" of the compound represented by the formula (1) based on the total mass of the surface layer.

Example 1

The electrophotographic photosensitive member produced in the photosensitive member production example 1 was evaluated by evaluation methods described below.

<Evaluation Apparatus>

Laser beam printer CP4525 manufactured by Canon Kabushiki Kaisha which was modified so that the circumferential speed of an electrophotographic photosensitive member was 300 mm/sec was used as an evaluation apparatus. The electrophotographic photosensitive member provided in the evaluation apparatus was replaced by the electrophotographic photosensitive member produced in the photosensitive member production example 1, and evaluation was performed.

An aluminum plate was used as the member for shielding or reducing pre-exposure. A process cartridge for the evaluation apparatus was adjusted so that Wc, W1, and Wp shown in FIG. 2 were Wc: 228 mm, W1: 209.5 mm, and Wp: 218 mm, respectively.

As a result of measurement of a quantity of pre-exposure light on the surface of the electrophotographic photosensitive member, pre-exposure in a region (non-image forming region) in which the pre-exposure was shielded by the member for shielding or reducing pre-exposure was reduced by 100%, that is, pre-exposure was completely shielded.

A method for measuring the quantity of pre-exposure light in the non-image forming region was as follows.

A photodiode (S33994-01, manufactured by Hamamatsu Photonics K.K.) was disposed at a light-receiving position of the electrophotographic photosensitive member and used for measurement.

Also, as a result of measurement of the surface potential before charging of the electrophotographic photosensitive member in a state in which pre-exposure was not shielded, the surface potential was −120 V. Further, as a result of measurement of the surface potential before charging of the electrophotographic photosensitive member in a state in which pre-exposure was 100% shielded, the surface potential was −420 V. In addition, as a result of measurement of the surface potential after charging of the electrophotographic photosensitive member was −500 V in both the state in which pre-exposure was shielded and the state in which pre-exposure was not shielded.

A method for measuring the surface potential of the electrophotographic photosensitive member was as follows.

A probe for surface potential measurement (MODDEL555-P1, manufactured by Trek Japan Co., Ltd.) was disposed at a position of 10 mm from the surface of the photosensitive member before charging, connected to a surface potential meter (MODEL344, manufactured by Trek Japan Co., Ltd.), and used for measuring the surface potential of the electrophotographic photosensitive member.

A relative value of the torque was evaluated in an environment of a temperature of 23° C. and a relative humidity of 50%.

<Evaluation of Relative Value of Torque>

An image was continuously output on 500 sheets of A4-size plain paper by using the evaluation apparatus. A test chart with a print ratio of 2% was used.

Then, the driving current value (current value A) of a rotation motor of the electrophotographic photosensitive member was measured. The aim of this evaluation was to evaluate a contact stress amount between the electrophotographic photosensitive member and the cleaning blade. The magnitude of the obtained current value indicates the magnitude of the contact stress amount between the electrophotographic photosensitive member and a member in contact with the electrophotographic photosensitive member, such as the cleaning blade or the like.

Also, an image was continuously output on 500 sheets and then a driving current value (current value B) was measured by the same method as for the current value A except that the member for shielding or reducing pre-exposure was not provided. A value of (current value A)/(current value B) calculated by using the current values A and B obtained was regarded as a relative value of torque. The obtained relative value of torque is shown in Table 2.

Also, as a result of measurement of a dynamic friction coefficient of the region (non-image forming region) in which pre-exposure was shielded or reduced by the member for shielding or reducing pre-exposure after image output on 500 sheets, the dynamic friction coefficient was 0.3. On the other hand, the dynamic friction coefficient of the image-forming region was 0.9.

A method for measuring the dynamic friction coefficient was as follows.

The dynamic friction coefficient was measured by using HEIDON-14 manufactured by Shinto Scientific Co. Ltd. at a temperature of 30° C. and a relative humidity of 55%. A urethane blade (rubber hardness 65°) cut into 5 mm×25 mm×2 mm was used as a rubber blade. The rubber blade was brought into contact at an angle of 25° with the surface of the electrophotographic photosensitive member under a load of 50 g applied, and the electrophotographic photosensitive member was moved in parallel at a speed of 50 mm/min. At the same time, the frictional force acting between the electrophotographic photosensitive member and the rubber blade was measured as a strain amount of a strain gauge attached to the blade side and converted to a tensile load. The dynamic friction coefficient was determined from [force (g) applied to the electrophotographic photosensitive member]/[load (g) applied to the blade] during movement of the blade.

Examples 2 to 14, 18, and 19

Evaluation was performed by the same method as in Example 1 except that the electrophotographic photosensitive member of Example 1 was changed to the electrophotographic photosensitive member produced in each of the photosensitive member production examples 2 to 14, 18, and 19 as shown in Table 2. The obtained relative values of torque are shown in Table 2.

Example 15

Evaluation was performed by the same method as in Example 1 except that a ND filter (manufactured by Fujifilm Corporation) ND0.3 was used as the member for shielding or reducing pre-exposure. The obtained relative value of torque is shown in Table 2.

As a result of measurement of a quantity of pre-exposure light on the surface of the electrophotographic photosensitive member, the quantity of pre-exposure light in a region (non-image forming region) in which pre-exposure was reduced by the member for shielding or reducing pre-exposure was reduced to 50%.

Also, as a result of measurement of the surface potential before charging of the electrophotographic photosensitive member in a state in which the quantity of pre-exposure light was reduced to 50%, the surface potential was −390 V.

Example 16

Evaluation was performed by the same method as in Example 1 except that a ND filter (manufactured by Fujifiim Corporation) ND0.2 was used as the member for shielding or reducing pre-exposure. The obtained relative value of torque is shown in Table 2.

As a result of measurement of a quantity of pre-exposure light on the surface of the electrophotographic photosensitive member, the quantity of pre-exposure light in a region (non-image forming region) in which pre-exposure was reduced by the member for shielding or reducing pre-exposure was reduced to 67%.

Also, as a result of measurement of the surface potential before charging of the electrophotographic photosensitive member in a state in which the quantity of pre-exposure light was reduced to 67%, the surface potential was −300 V.

Example 17

Evaluation was performed by the same method as in Example 1 except that a ND filter (manufactured by Fujifilm Corporation) ND0.1 was used as the member for shielding or reducing pre-exposure. The obtained relative value of torque is shown in Table 2.

As a result of measurement of a quantity of pre-exposure light on the surface of the electrophotographic photosensitive member, the quantity of pre-exposure light in a region (non-image forming region) in which pre-exposure was reduced by the member for shielding or reducing pre-exposure was reduced to 10%.

Also, as a result of measurement of the surface potential before charging of the electrophotographic photosensitive member in a state in which the quantity of pre-exposure light was reduced to 10%, the surface potential was −415 V.

Comparative Example 1

Evaluation was performed by the same method as in Example 1 except that the member for shielding or reducing pre-exposure was not used. The obtained relative value of torque is shown in Table 2.

As a result of measurement of the dynamic fraction coefficient of the same region as the non-image forming region in Example 1, the dynamic friction coefficient was 0.9.

Comparative Example 2

Evaluation was performed by the same method as in Example 2 except that the member for shielding or reducing pre-exposure was not used. The obtained relative value of torque is shown in Table 2

Comparative Example 3

Evaluation was performed by the same method as in Example 1 except that the electrophotographic photosensitive member was changed to the electrophotographic photosensitive member produced in the production example 15. The obtained relative value of torque is shown in Table 2.

Comparative Example 4

Evaluation was performed by the same method as in Example 1 except that the electrophotographic photosensitive member was changed to the electrophotographic photosensitive member produced in the production example 16. The obtained relative value of torque is shown in Table 2.

Comparative Example 5

A relative value of torque was determined and evaluated by the same method as in Example 13 except that the member for shielding or reducing pre-exposure was not used. The obtained relative value of torque is shown in Table 2.

TABLE 2

| | Photosensitive member production example | Light quantity reducing member | Relative value of torque |
|---|---|---|---|
| Example 1 | Production example 1 | Al | 0.80 |
| Example 2 | Production example 2 | Al | 0.68 |
| Example 3 | Production example 3 | Al | 0.60 |
| Example 4 | Production example 4 | Al | 0.80 |
| Example 5 | Production example 5 | Al | 0.76 |
| Example 6 | Production example 6 | Al | 0.62 |
| Example 7 | Production example 7 | Al | 0.91 |
| Example 8 | Production example 8 | Al | 0.78 |
| Example 9 | Production example 9 | Al | 0.76 |
| Example 10 | Production example 10 | Al | 0.70 |
| Example 11 | Production example 11 | Al | 0.75 |
| Example 12 | Production example 12 | Al | 0.77 |
| Example 13 | Production example 13 | Al | 0.55 |
| Example 14 | Production example 14 | Al | 0.90 |
| Example 15 | Production example 1 | ND0.3 | 0.85 |
| Example 16 | Production example 1 | ND0.2 | 0.96 |
| Example 17 | Production example 1 | ND1.0 | 0.81 |
| Example 18 | Production example 17 | Al | 0.60 |
| Example 19 | Production example 18 | Al | 0.54 |
| Comparative Example 1 | Production example 1 | No | 1.00 |
| Comparative Example 2 | Production example 2 | No | 0.98 |
| Comparative Example 3 | Production example 15 | Yes | 2.00 |
| Comparative Example 4 | Production example 16 | Yes | 2.10 |
| Comparative Example 5 | Production example 13 | No | 0.97 |

Comparison between Example 1 and Comparative Example 1 and comparison between Example 10 and Comparative Example 5 indicate that the effect of decreasing torque can be obtained by providing the member for shielding or reducing pre-exposure.

Comparison between Examples 1 to 17 and Comparative Examples 3 and 4 indicates that even when the member for shielding or reducing pre-exposure is provided, the effect of decreasing torque cannot be obtained by the electrophotographic photosensitive member not containing a structure represented by the formula (1).

Comparison between Examples 2, 3, 6, 10, 18 and 19 and Example 1 indicates that the particularly high effect of decreasing torque can be obtained by using the resin having a structure represented by the formula (1) at a terminal of the main chain and using the member for shielding and reducing pre-exposure.

Comparison between Examples 1, 15, 16, and 17 and Comparative Example 1 indicates that the effect of decreasing torque can be obtained when a surface potential difference between before and after charging in the non-image forming region of the electrophotographic photosensitive member is within a range of 200 V or less.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-138902, filed Jul. 10, 2015 which is hereby incorporated by reference herein in its entirety.

What is claimed is:

1. An image forming method comprising:

(1) charging the surface of an electrophotographic photosensitive member;

(2) forming an electrostatic latent image by exposing the charged surface of the electrophotographic photosensitive member;

(3) forming a toner image on the surface of the electrophotographic photosensitive member by developing the electrostatic latent image with a toner, (4) transferring the toner image to a transfer material through or without an intermediate transfer body;

(5) removing the transfer residual toner from the surface of the electrophotographic photosensitive member after the toner image is transferred, and (6) irradiating the surface of the electrophotographic photosensitive member, from which the transfer residual toner has been removed, with destaticizing light for eliminating residual charge on the surface of the electrophotographic photosensitive member, wherein a surface layer of the electrophotographic photosensitive member contains a compound having a structure represented by formula (1) below in an amount of 0.1% to 10% by mass based on the total mass of the surface layer, and when in a charged region of the surface of the electrophotographic photosensitive member charged in the step (1), a charged region in which the electrostatic latent image is formed in the step (2) is referred to as an "image forming region" and a charged region in which the electrostatic latent image is not formed is referred to as a "non-image forming region", the non-image forming region is not irradiated with the destaticizing light or is irradiated with the reduced destaticizing light in the step (6), (1)

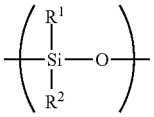

in the formula (1), $R^1$ and $R^2$ each independently represent a methyl group, an ethyl group, or a phenyl group.

2. The image forming method according to claim 1, wherein the weight-average molecular weight (Mw) of the compound having a structure represented by the formula (1) is 5,000 or more and 500,000 or less.

3. The image forming method according to claim 1, wherein the content of a structure represented by formula (1) in the compound having a structure represented by formula (1) is 10% by mass or more and 90% by mass or less.

4. The image forming method according to claim 1, wherein the compound having a structure represented by formula (1) is a compound having at least one structure selected from the group consisting of formulae (1-A), (1-B), (1-C), and (1-D):

wherein in formula (1-A), $Y^1$ represents a single bond, a methylene group, an ethylidene group, a propylidene group, a phenylethylidene group, a cyclohexylidene group, or an oxygen atom, $R^{21}$ and $R^{22}$ each independently represent a methyl group or an ethyl group, and n1 and n2 each independently represent an average number of repetitions of a structure in brackets and are each independently 20 or more and 200 or less;

wherein in formula (1-B), $R^{31}$ represents a methyl group, an ethyl group, a propyl group, or a butyl group, and n3 represents an average number of repetitions of a structure in brackets and is 20 or more and 200 or less;

wherein in formula (1-C), $R^{41}$ represents a methyl group or an ethyl group, and n4, n5, and n6 each independently represent an average number of repetitions of a structure in brackets and are each independently 20 or more and 200 or less; and wherein in formula (1-D), n7 represents an average number of repetitions of a structure in brackets and is 20 or more and 200 or less.

5. The image forming method according to claim 1, wherein the surface layer of the electrophotographic photosensitive member further contains a resin having at least one structure selected from the group consisting of formula (2) and (3):

(1-A)

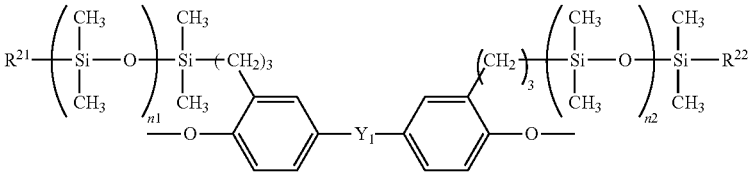

(1-B)

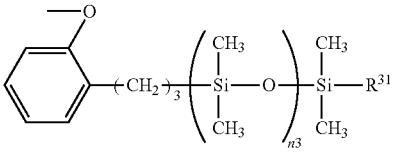

(1-C)

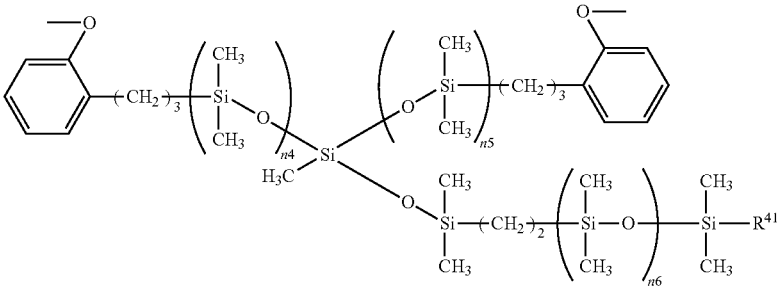

(1-D)

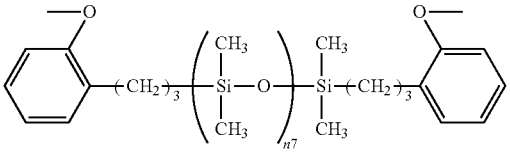

(2)

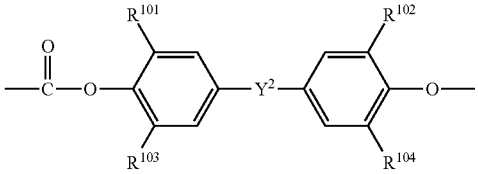

wherein in formula (2), $R^{101}$ to $R^{104}$ each independently represent a methyl group or an ethyl group, and $Y^2$ represents a single bond, a methylene group, an ethylidene group, a propylidene group, a phenylethylidene group, a cyclohexylidene group, or an oxygen atom;

(3)

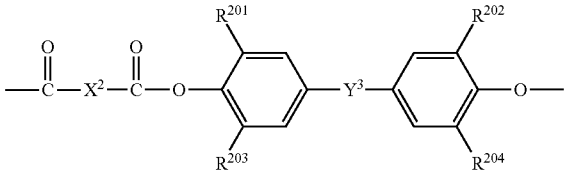

wherein in formula (3), $R^{201}$ to $R^{204}$ each independently represent a methyl group or an ethyl group, $Y^3$ represents a single bond, a methylene group, an ethylidene group, a propylidene group, a phenylethylidene group, a cyclohexylidene group, or an oxygen atom, and $X^2$ represents a phenylene group or a structure represented by the following formula (4)

(4)

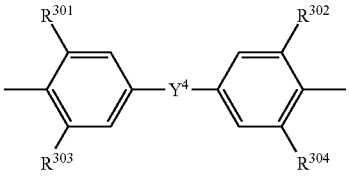

wherein in formula (4), $R^{301}$ to $R^{304}$ each independently represent a methyl group or an ethyl group, and $Y^4$ represents a single bond, a methylene group, an ethylidene group, a propylidene group, a phenylethylidene group, a cyclohexylidene group, or an oxygen atom.

6. The image forming method according to claim 5, wherein the surface layer of the electrophotographic photosensitive member contains a resin having a structure represented by formula (2) in which $Y^2$ is a single bond.

7. The image forming method according to claim 5, wherein the surface layer of the electrophotographic photosensitive member contains a resin having a structure represented by formula (3) in which $Y^3$ is a single bond.

8. The image forming method according to claim 1, wherein when Wc represents a charging width in the longitudinal direction of the surface of electrophotographic photosensitive member charged in the step (1), W1 represents an electrostatic latent image forming width in the longitudinal direction of the surface of the electrophotographic photosensitive member on which the electrostatic latent image is formed in the step (2), and Wp represents an exposure width in the longitudinal direction of the surface of the electrophotographic photosensitive member irradiated with unreduced destaticizing light in the step (6), Wc, Wp, and W1 satisfy the following formula:

$$Wc>Wp>W1.$$

9. The image forming method according to claim 1, wherein the circumferential speed of the electrophotographic photosensitive member is 250 mm/sec or more.

10. The image forming method according to claim 1, wherein a surface potential difference between before and after charging in the non-image forming region of the electrophotographic photosensitive member is 200 V or less.

11. A process cartridge comprising:

an electrophotographic photosensitive member;

a charging unit that charges the surface of the electrophotographic photosensitive member;

a cleaning unit that removes a toner from the surface the electrophotographic photosensitive member; and a static elimination unit that removes residual charge from the surface the electrophotographic photosensitive member by irradiating the surface of the electrophotographic photosensitive member with destaticizing light, the process cartridge being configured to be detachable from the body of an electrophotographic apparatus, wherein a surface layer of the electrophotographic photosensitive member contains a compound having a structure represented by formula (1) below in an amount of 0.1% to 10% by mass based on the total mass of the surface layer; and when in a charged region of the surface of the electrophotographic photosensitive member charged by the charging unit, a charged region in which the electrostatic latent image is formed is referred to as an "image forming region" and a charged region in which the electrostatic latent image is not formed is referred to as a "non-image forming region", the process cartridge further comprises a member for shielding or reducing the destaticizing light irradiating the non-image forming region, (1)

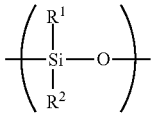

in formula (1), $R^1$ and $R^2$ each independently represent a methyl group, an ethyl group, or a phenyl group.

12. An electrophotographic apparatus comprising:

an electrophotographic photosensitive member;

a charging unit that charges the surface of the electrophotographic photosensitive member;

an electrostatic latent image forming unit that forms an electrostatic latent image by exposing the charged surface of the electrophotographic photosensitive member;

a development unit that forms a toner image on the surface of the electrophotographic photosensitive member by developing the electrostatic latent image with a toner;

a transfer unit that transfers the toner image to a transfer material through or without through an intermediate transfer body;

a cleaning unit that removes the toner from the surface the electrophotographic photosensitive member; and a static elimination unit that removes residual charge from the surface the electrophotographic photosensitive member by irradiating the surface of the electrophotographic photosensitive member with destaticizing light, wherein a surface layer of the electrophotographic photosensitive member contains a compound having a structure represented by formula (1) below in an amount of 0.1% to 10% by mass based on the total mass of the surface layer; and when in a charged region of the surface of the electrophotographic photosensitive member charged by the charging unit, a charged region in which the electrostatic latent image is formed is referred to as an "image forming region" and a charged region in which the electrostatic latent image is not formed is referred to as a "non-image forming region", the electrophotographic apparatus further comprises a member for shielding or reducing the destaticizing light irradiating the non-image forming region, (1)

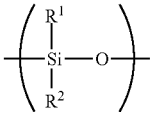

wherein in formula (1), $R^1$ and $R^2$ each independently represent a methyl group, an ethyl group, or a phenyl group.

* * * * *